United States Patent [19]

DeBin et al.

[11] Patent Number: 4,850,781

[45] Date of Patent: Jul. 25, 1989

[54] ZERO CYCLE INTERRUPT WICKET STACKER

[75] Inventors: Rene F. DeBin, Aalst; William Van Der Gucht, both of Aalst, Belgium

[73] Assignee: FMC Corporation, Chicago, Ill.

[21] Appl. No.: 224,184

[22] Filed: Jul. 22, 1988

Related U.S. Application Data

[63] Continuation of Ser. No. 927,295, Nov. 3, 1986, abandoned.

[51] Int. Cl.[4] ..... B65H 29/40; B65H 31/32

[52] U.S. Cl. ..... 414/27; 271/196; 271/218; 414/790.4; 414/790.8; 414/793

[58] Field of Search ..... 414/27, 45, 47, 50, 414/72; 271/196, 218, 903; 493/204; 198/692

[56] References Cited

U.S. PATENT DOCUMENTS

| | | | |
|---|---|---|---|
| 3,625,338 | 12/1971 | Cawley | 414/27 X |
| 3,631,771 | 1/1972 | Schwarzkopf et al. | 414/45 X |
| 3,672,118 | 6/1972 | DeJong et al. | 414/47 X |
| 4,357,126 | 11/1982 | Kidd et al. | 271/218 X |
| 4,573,955 | 3/1986 | Mory et al. | 414/72 X |
| 4,642,013 | 2/1987 | Mundus et al. | 414/50 X |
| 4,668,148 | 5/1987 | Sample et al. | 414/50 |

FOREIGN PATENT DOCUMENTS 2048831 12/1980 United Kingdom .

*Primary Examiner*—Leslie J. Paperner

*Attorney, Agent, or Firm*—Douglas W. Rudy; Richard B. Megley

[57] ABSTRACT

A wicket type bag stacking machine is provided with apparatus for accumulating articles being stacked on a temporary stack so that stacked articles on the production stacking station can be removed. Upon removal of stacked articles from the production stacking station an empty stacking station is provided and the articles temporarily stacked on the temporary stack are positioned on the production stacking station.

1 Claim, 2 Drawing Sheets

ZERO CYCLE INTERRUPT WICKET STACKER

This application is a continuation of application Ser. No. 927,295, filed 11/03/86, now abandoned.

In the manufacture of articles, for instance plastic bags or web segments that are further processed to produce bags, it is known to use a wicket stacking article accumulator that allows the articles to be uniformly stacked.

Such a wicket stacking apparatus is shown in U.S. Pat. No. 4,573,955 to Mory, et al. The typical wicket stacking apparatus uses radially extending circumferentially spaced arms for transporting the articles from the forming machine to the stacking station which includes upwardly projecting pins or posts connected to the supporting plate. Supporting plates are attached to take away mechanism such as a chain conveyor that takes away a full stack of articles and positions an empty supporting plate, with empty upstanding wickets, in position under the spaced arms to collect a stack of articles on the newly placed supporting plate.

The normal wicket stacking machine is well known and would be the basic environment for the improvement provided by the apparatus of this invention.

One difficulty with conventional wicket stackers is that it is difficult to maximize production of the bag making machine due to the time constraint placed on the bag machine while the stacking apparatus serves an empty wicket containing stacking plate to the output of the bag making machine. In the past it has been necessary to interrupt the output of the machine for at least several cycles while an empty stacking plate is positioned. Another method of accomodating the dwell time necessary to position an empty stacking plate has been to run the bag or article making machine at less than maximum bag making capacity thus accomodating the stacking station capability. Neither of these two solutions are effective machine utilizations.

The instant invention presents a method of temporarily accumulating articles on wickets while an empty production wicket stand is placed into position to receive articles in a conventional manner. The temporary accumulator will be discribed in the following specification when read in conjunction with the drawings wherein.

Figure 1:
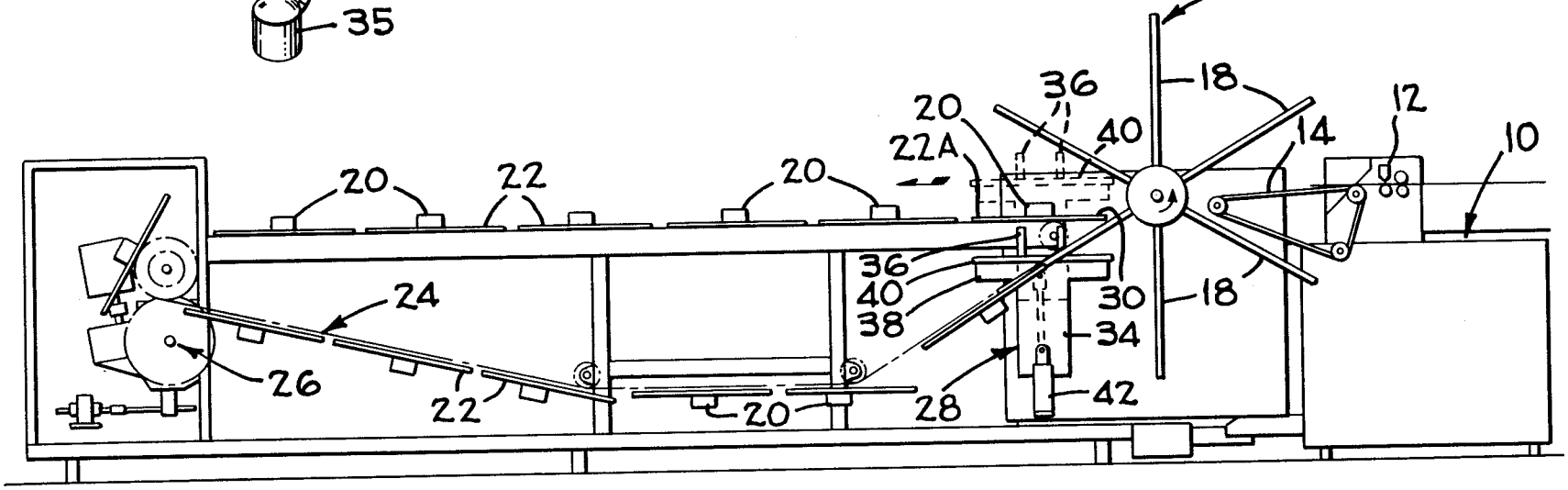
FIG. 1 is a conventional bag making machine and includes wicketed stacking plates on an endless conveyor.
Figure 5:
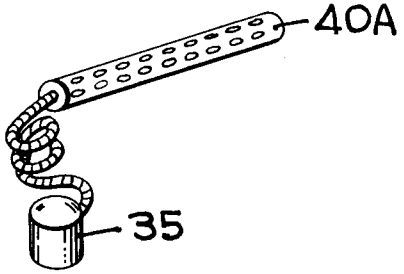
FIG. 5 is a modified interrupt support that is an alternative to the standard interrupt support.

FIG. 1 is presented to show the general embodiment of the invention. That is, generally a bag making machine representatively shown as 10 having a sealing and cutting head 12 and a take away apparatus 14 which will serve the articles being made, for instance bags, to a transfer means, generally 16, having radially extending circumferentially spaced apart arms such as 18 which will be vacuum arms of the type shown in U.S. Pat. No. 4,573,955 mentioned above that will hold both ends of the bag or article to the arms after the article is picked up from the take away apparatus 14. The circumferentially spaced apart arms 18 are supported on a transverse support shaft 17 having at each end thereof enlarged hollow hubs 19 being connected to a source of vacuum. Each hub has rigidly connected to its outer circular periphery of series of radially extending, equally circumferentially spaced hollow bars 18 provided, on a selected surface, with a series of holes 21 extending for a substantial length of the surface of the bars or arms 18 as is shown in the figures and as is taught by U.S. Pat. No. 4,573,955. The articles will be held by the arms until the articles are impinged on the wickets such as 20 in a conventional manner. The wickets are carried by stands such as 22 on an endless conveyor 24. Articles are off loaded from the wicket stands at some point between the arms 18 and the wicket stand drive generally 26.

The zero cycle interrupt means generally 28 is installed at the loading station of the first production stand 30 location and will be operative to accumulate articles being delivered to the first production stand location 30. The cycle interrupt means 28 can be driven by well known conventional means including gears and belts to be indexed into position after a given number of articles have been delivered to the first production stand by the transfer means 16.

Figure 2:
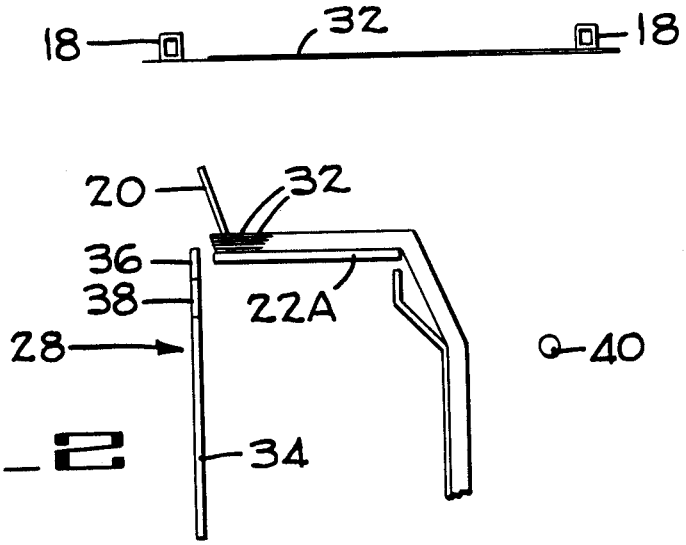
FIG. 2 is a schematic depiction of a production wicket stand having bags being stacked thereon.
Figure 3:
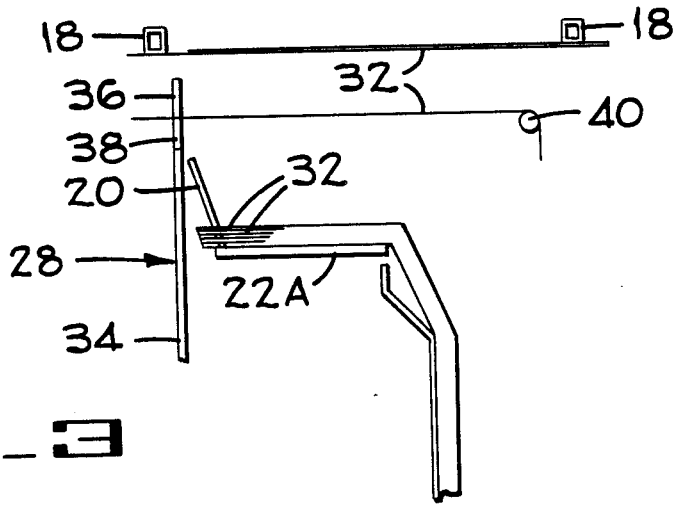
FIG. 3 is a schematic depiction of a temporary accumulator in operating position.
Figure 4:
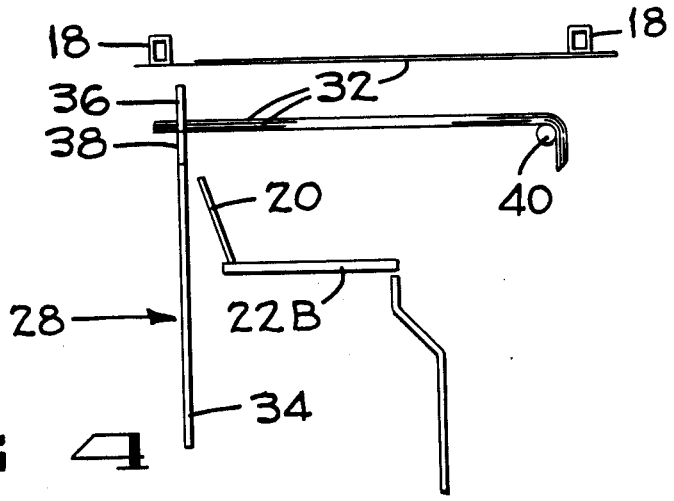
FIG. 4 is a schematic depiction of a full temporary accumulator.

FIGS. 2 through 4 best show the concept of the zero cycle interrupt means generally 28. These figures are schematic representation of apparatus that could be of diverse design such as a cam drive, timing belt drive, gear drive or other conventional drive means.

The zero cycle interrupt means generally 28 is positioned at the first production stand location 30 where the wicket stand 22A is being loaded with articles being delivered from the transfer means generally 16 and specifically the arms 18. The article 32 is, for instance, a bag that has been provided with an aperture or a set of apertures at one end thereof, the left end in FIGS. 2–4. The bag is held to the arms 18 by vacuum as the arms deliver the bag to the wickets 20 on the wicket stands such as 22A. In FIG. 2 a plurality of bags 32 have accumulated on the wicket stand 22A and when a predetermined number of bags have accumulated thereon the zero cycle interrupt generally 28 will be indexed into position to accumulate bags while the full wicket stand 22A is moved by the continuous conveyor to a non-production location downstream of the production stacking station.

In FIG. 3 the zero cycle interrupt has been moved into position to accept the next bag 32 being delivered by the arms 18. The interrupt stacking plate 34 is provided with a wicket portion 36 and a cross arm portion 38. The wicket portion 36 acts like the wicket 20 on the production stand 22 and will be indexed through the aperture of the bag 32 when the interrupt stacking plate 34 is raised by its linkage into position above the wicket 20 of the production stacking plate. The cross arm portion 38 of the interrupt stacking plate 34 supports the portions of the bag 32 outboard of the aperture or handle of the bag when the bags are impaled on the wicket 36.

An interrupt support 40 which may be tubular element, is moved simultaneously with the interrupt stacking plate 34 into position inboard of the proximate arm 28 but outboard of the stand 22.

The bag 32 is then supported by the interrupt stacking plate and the interrupt support 40 for several passes of the arms 18 and the stacking of a given number of bags 32 on the interrupt stacking plate 34 and the interrupt support 40. During this interruption of production the full stand 22A can be moved out of the production position and an empty wicket stand such as 22B will be moved into a production position.

In FIG. 1 the dotted line position shows the interrupt stacking plate 34 and the interrupt support 40 in position to receive the first bag 32 in FIG. 3.

FIG. 4 shows the interrupt stacking plate 34 and the interrupt support 40 fully ladened with bags 32 and the stand 22B ready to start receiving bags. At this point the interrupt stacking plate 34 and the interrupt support 40 will be quickly lowered so that the bags 32 are impaled on the wicket 20 and rest on the stand 22B. The zero cycle interrupt means generally 28 will now be unutilized until a given preset number of bags are accumulated on the production wicket stand 22B, whence the cycle will be repeated.

The interrupt stacking plate 34 may be operated simultaneously through a linked connection with the interrupt support 40 by means of an air operated cylinder 42 (FIG. 1, left out of FIGS. 2–4 for clarity) or other mechanical expediant as is well known in the art to urge an element from one location to a displaced location.

The dotted line presentation in FIG. 1 shows the interrupt stacking plate 34 and the interrupt support in the upwardly extended position where it receives bags as per FIG. 3. The normal position for the zero cycle interrupt means, generally 28, would be the solid line position as shown.

An alternative embodiment of the interrupt stacking plate would have a single upstanding wicket similar to the wickets 20 on the stands 22. As long as the apperture in the bag could accommodate the wicket on the production stacking plate and the wicket on the interrupt stacking plate almost any shape of wicket could be used. The dual upstanding prongs shown in FIG. 1 are just one possible embodiment.

A further alternative embodiment would utilize a modified interrupt support wherein a plurality of apertures would be provided in the upper surface and possibly the outboard surface of the interrupt support and a vacuum source applied to the apertured interrupt support to assist in holding the first bag on the interrupt support when the zero cycle interrupt means is first urged into a collection position.

Although the best mode contemplated for carrying out the present invention has been herein shown and described, it will be apparent that modification and variation may be made without departing from what is regarded to be the subject matter of the invention.

What is claimed is:

1. A zero cycle interrupt means, moveable in a vertical plane, for receiving articles having an aperture therein from an article serving means for serving said articles to an indexed, moveable production wicket stand having an upwardly extending wicket directed toward the vertical plane of the zero cycle interrupt means, said zero cycle interrupt means comprising:

an interrupt stacking plate having a wicket portion and a cross arm portion, said interrupt stacking plate mounted for reciprocal motion in said vertical plane from a position below said wicket stand to a position above said wicket stand;

an interrupt support mounted for reciprocal movement in cooperation with said interrupt stacking plate below said wicket stand to a position above said wicket stand;

said interrupt stacking plate and said interrupt support receiving said articles from said article server only when said wicket stand is being moved from a first indexed position;

said wicket portion of said interrupt stacking plate having a pair of upwardly extending elements spaced apart from each other a distance greater than the width of said upwardly extending wicket of said wicket stand;

whereby said interrupt stacking plate and said interrupt support can be moved vertically upward to accept articles on said wickets of said interrupt stacking plate and on said interrupt support from said article serving means and can be moved vertically downward past said wicket of said production wicket stand whereby said article carried on said wickets of said interrupt stacking plate will be engaged by said wicket of said production wicket stand.

* * * * *